United States Patent [19]

Pardo

[11] Patent Number: 4,655,018

[45] Date of Patent: Apr. 7, 1987

[54] ROOF PAVER ELEMENT AND SYSTEM

[75] Inventor: Jorge Pardo, Reston, Va.

[73] Assignee: National Concrete Masonry Association, Herndon, Va.

[21] Appl. No.: 696,710

[22] Filed: Jan. 31, 1985

[51] Int. Cl.[4] ..... E04B 1/70

[52] U.S. Cl. ..... 52/302; 52/602; 52/513; 52/506

[58] Field of Search ..... 52/408, 602, 513, 302, 52/506, 379, 229

[56] References Cited

U.S. PATENT DOCUMENTS

| | | | |
|---|---|---|---|
| 430,364 | 6/1890 | Babcock . | |
| 1,675,093 | 6/1928 | Conley . | |
| 1,992,756 | 2/1935 | Masterson | 52/379 X |
| 2,018,201 | 10/1935 | Currie . | |
| 2,192,691 | 3/1940 | Mutch . | |
| 2,624,298 | 1/1953 | Farren . | |
| 3,079,729 | 3/1963 | Newton et al. . | |
| 3,387,420 | 6/1968 | Long . | |
| 3,453,833 | 7/1969 | Joosten | 52/602 |
| 3,455,076 | 7/1969 | Clarvoe . | |
| 3,828,498 | 8/1974 | Jones . | |
| 3,962,088 | 6/1976 | Kuhlenschmidt et al. | 52/227 X |
| 4,214,408 | 7/1980 | Rich, Jr. . | |
| 4,278,071 | 7/1981 | Brill-Edwards . | |
| 4,506,483 | 3/1985 | Phalen, Jr. | 52/408 |

FOREIGN PATENT DOCUMENTS

| | | | |
|---|---|---|---|
| 20224 | 9/1908 | United Kingdom | 52/602 |

OTHER PUBLICATIONS

"Roofblok"-Roofblok Limited, Waltham, MA.
"Foster Roof Paver & Rebar Supports"-Foster Masonry Products, Acton, MA.
"Prior Art At", (one sheet).

*Primary Examiner*—Carl D. Friedman
*Attorney, Agent, or Firm*—Lane & Aitken

[57] ABSTRACT

A roof paver system includes a plurality of roof paver elements having alternating dovetail-shaped and tapered grooves and an upper surface having raised portions to generate vortexes for preventing wind from lifting the elements and to provide a safety tread. Connecting members are provided in some of the dovetail grooves to interconnect the roof paver elements and further prevent their displacement. The tapered grooves break the vacuum between the roof paver elements and the molds in which they are formed. Clips are provided to mate with outwardly projecting toes on the roof paver elements in perimeter courses to align and anchor them, and elongate battens, which are dovetail-shaped in cross section, are received in the dovetail grooves and include openings for receiving thin elements transverse to the battens to engage the concrete elements at the ends of the grooves.

25 Claims, 9 Drawing Figures

ROOF PAVER ELEMENT AND SYSTEM

BACKGROUND OF THE INVENTION

The present invention relates to a roof paver element and a roof paver system including a plurality of interconnected roof paver elements for covering roofs and, especially, for covering the membranes of single-ply roofing systems.

For most types of low-slope roofs, roof ballast is used to hold down the roofing membrane against the roof deck when wind conditions may create negative pressures tending to lift the membranes. The ballast also protects the membranes from ultraviolet radiation and puncture or impact damage by maintenance crews and windblown objects. The standard form for roof ballast has traditionally been a smooth, round "river wash" type of gravel which is spread uniformly to produce a minimum of 10 lb/sf load on the membrane. However, the use of gravel as roof ballast has been reviewed in recent years in light of the development of new single-ply roofing systems and the extensive damage caused to buildings near gravel ballast roofs as the result of flying gravel in hurricane type conditions. New single-ply roofing membranes, as opposed to the conventional multi-ply "built up" roofing systems, do not use hot bitumen for holding the membranes in place, and in some cases, the single-ply membranes are laid loosely on the roof deck without fasteners other than at the perimeter, which means that heavier than usual ballast is desirable to keep the membrane down. In addition, because the gravel ballast does not adhere to the single-ply membranes as it adhered to the bitumen in the asphalt-based systems, there is a greater potential hazard of gravel flying under extreme wind conditions.

In order to overcome the drawbacks of gravel ballast, flat concrete paver elements and systems have been developed which provide adequate ballast to hold down the roof membrane and protect it from ultraviolet radiation and impact damage, but each suffers from at least one of several disadvantages. Some of the prior art roof paver elements require special concrete molding equipment, drying racks and handling equipment, even though they are produced by manufacturers already having conventional equipment of the same types for producing standard concrete blocks. This is due to the fact that the designs of the known paver elements require the elements to have non-standard dimensions to provide roof drainage or for other purposes, and even with such special dimensions, the provision for roof drainage is not always adequate and/or permits drainage in only one direction. Some roof paver elements have flat upper surfaces which allow air to flow uninterrupted across the elements at high speeds, producing negative pressures which can lift and displace the elements. In addition, known roof paver systems do not provide a convenient arrangement for aligning and anchoring the paver elements in courses around the perimeter of the roof or a system for preventing the paver elements from sliding when they are installed in roofs having higher slopes.

SUMMARY OF THE INVENTION

In accordance with the present invention, a roof paver system includes roof paver elements which can be produced in a standard concrete block mold machine, dried on standard drying racks and handled with conventional concrete block material handling equipment.

The length and width of the paver elements correspond to two of the dimensions of a standard concrete block mold machine, and the height of the elements is such that a plurality of such elements can be accommodated at one time in the mold.

Each roof paver element has a larger footprint than previously known roof pavers, that is, a larger proportion of its surface area contacts the roof to provide a greater weight distribution and a reduced likelihood of damage to the roof membrane. The roof paver elements according to the present invention allow a far greater drainage volume than other roof paver elements by providing more and larger drainage grooves, and they permit the drainage in two directions. The elements have a higher thermal insulating value than previously known roof paver elements by their ability to trap a larger volume of air in the drainage grooves, and, by tapering alternate drainage grooves, the roof paver elements provide a mechanism for immediately breaking the vacuum between the elements and the concrete mold when the elements are formed, thereby reducing forces which retain completed elements in the mold and increasing the speed and ease with which the elements can be molded.

The ends of the elements cooperate with one another to define composite drainage grooves for receiving and retaining separate connecting members for interlocking the elements to provide an integrated roof paver system, thereby preventing individual elements from being lifted and moved out of position by high winds. The drainage grooves within each element which are not tapered are shaped like the composite grooves, providing a relatively narrow space at the roof membrane but increased area above for greater drainage. The effect of high winds is also diminished by the provision of raised portions on the top surface of each roof paver element for generating air vortexes to break up the smooth flow of air which tends to lift the elements as it moves across them. The raised portions also define a safety tread which helps prevent workmen from slipping.

For some installations, such as those having a low fascia, the roof paver system employs clips along its perimeter for aligning the roof paver elements at the start of laying and for anchoring them to the roof. For roofs having high slopes, the system includes elongate battens securable to the roof membrane and shaped to be slid into and retained in the shaped alternate grooves of the paver elements, the battens having apertures to accommodate transverse stop members for abutting the downslope edge of the paver elements.

DETAILED DESCRIPTION OF THE PREFERRED EMBODIMENTS

Figure 1:
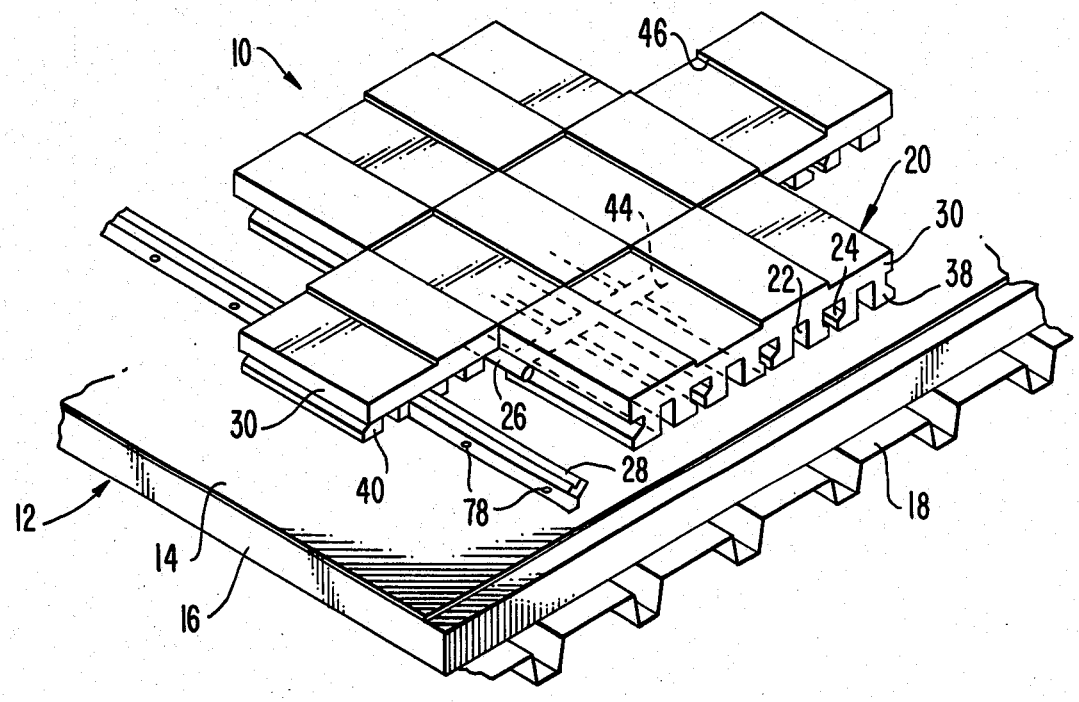
FIG. 1 is a perspective view of a roof paver system in place on a roof.

In FIG. 1 of the drawings, a exemplary embodiment of an integrated roof paver system 10 according to the present invention is shown in place on a roof 12, such as a flat or low-slope roof, in which a roof membrane 14 overlies insulation 16 on top of a roof deck 18. The roof paver system 10 includes a plurality of roof paver elements 20, four of which are shown, each of which contains a plurality of tapered grooves 22 and alternating dovetail-shaped grooves 24 on the underside to allow the drainage of water and to trap air for thermal insulation. In addition, the dovetail grooves 24 receive connector members 26, such as standard one-inch plastic tube connectors, to positively interlock the roof paver elements 20 in the system 10, and dovetail-shaped battens 28 to secure the paver elements 20 to the roof 12 and to keep the paver elements from sliding on roofs having a relatively high slope. In the embodiment illustrated, the courses of roof paver elements 20 are staggered to permit total interlocking of the roof paver system 10, but it is understood that the roof paver elements 20 of adjacent courses can be in alignment if desired.

Figure 2:
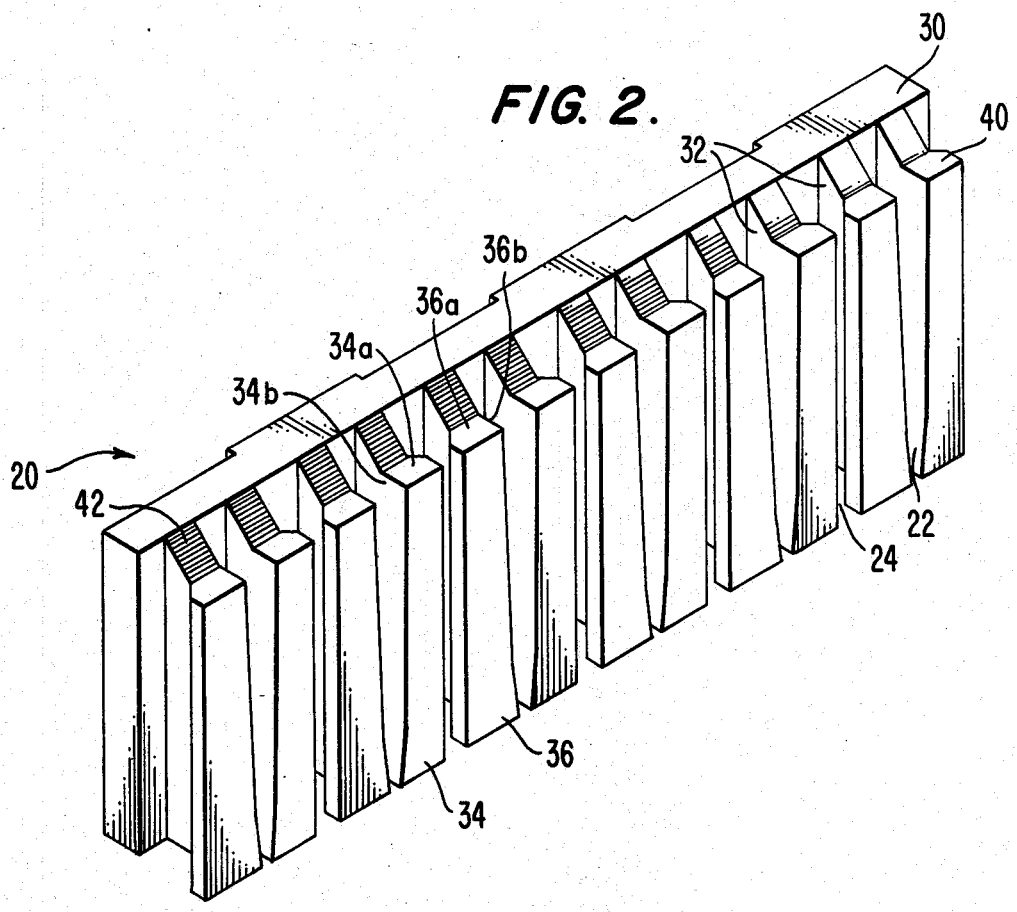
FIG. 2 is a perspective view of a roof paver element according to the present invention.

As can be seen from FIG. 2, the roof paver element 20 is a thin shell block element preferably made of concrete and having dimensions which permit it to be molded readily in a standard concrete block mold box. For this reason, a preferred embodiment of the roof paver element has nominal dimensions of 16 in.×8 in.×2.5 in. so that a mold box which can produce, for example, three standard concrete blocks at a time can produce six thin shell roof paver elements at a time. A roof paver element 20 according to the present invention having the above dimensions has a ballast weight of 11 pounds per square foot, a coverage of 0.88 square feet, a footprint of 81.5 square inches per square foot of coverage, and an insulating value of 1.6 R (sf). The roof paver element 20 includes an elongate planar portion 30 which defines the upper portion of the paver element 20 when it is in place on a roof, and projecting from the planar portion 30 are a plurality of spaced ribs 32 terminating in broadened feet 34 and 36 which include toe portions 34*a* and 36*a*, respectively, and heel portions 34*b* and 36*b*. The area of the feet 24 and 26 which contacts the roof, that is, the footprint, is made greater than the cross-sectional area of the ribs 32 to provide increased weight distribution and to diminish the likelihood of damage to the roof membrane. The dovetail grooves 24 are defined between adjacent ribs 32 and facing toe portions 34*a* and 36*a* of the feet 34 and 36, so that the region above the toe portions 34*a* and 36*a* has an increased cross sectional area to accommodate a large volume of drainage. The tapered grooves 22, which are defined between adjacent ribs 32 and the heel portions 34*b* and 36*b* of the feet 34 and 36, taper longitudinally to provide a mechanism for breaking the vacuum between the tapered grooves 22 and the mold as the roof paver elements 20 are slid out of the mold in a direction parallel to the grooves 22 and 24. The breaking of the vacuum between the tapered grooves 22 and the portions of the mold they contact reduces the overall forces retaining the paver elements 20 in the mold so that the elements can be slid out easily.

The feet 34 and 36 are shorter than the parallel dimension of the planar portion 30, each foot having a flush end 38 which is coplanar with an edge of the planar portion 30 and a recessed end 40 which is connected by a beveled portion 42 of the ribs 32 to an opposite edge of the planar portion 30, as can best be seen from FIGS. 1 and 2. When the paver elements 20 are in place on a roof, the space between the recessed ends 40 of the feet 34 and 36 and the adjacent edge of the planar portion 30 define with the beveled portions 42 of the ribs 32 a drainage passage which is transverse to the drainage provided by the dovetail grooves 24 and the tapered grooves 22. FIG. 1 shows in dotted lines a transverse drainage passage 44 of double width defined by the juxtaposition of the recessed ends 40 of the feet 34 and 36 of one paver element 20 with the recessed ends 40 of the paver elements 20 in the adjacent course. By this arrangement, a double width transverse drainage passage 44 is defined after every two courses of paver elements 20, there being no significant transverse drainage at the abutment of the paver elements between the drainage passages 44. The paver elements 20 can also be laid with the recessed ends 40 in each paver element 20 juxtaposed with the flush ends 38 of the feet 34 and 36 of paver elements 20, so that a transverse drainage passage of single width is defined after every course of paver elements 20.

Figure 3:
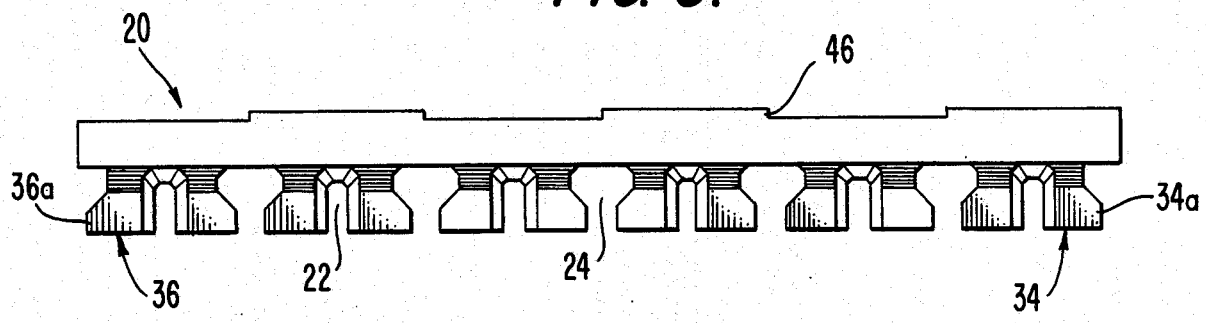
FIG. 3 is a top view of the roof paver element of FIG. 2.
Figure 4:
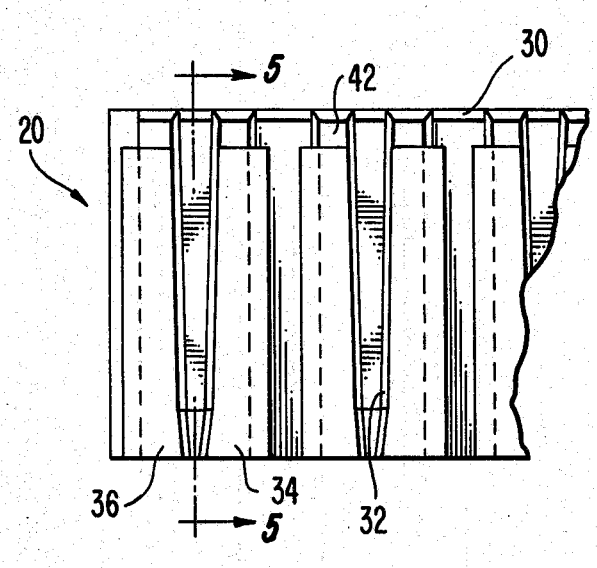
FIG. 4 is a partial front view of the roof paver element of FIG. 2.
Figure 5:
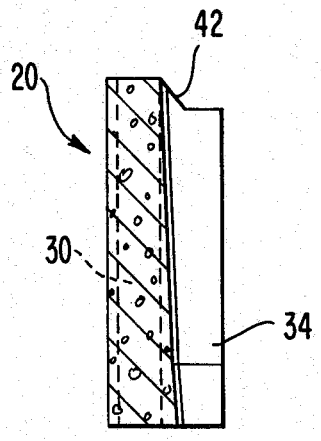
FIG. 5 is a cross-section taken along the line 5—5 in FIG. 4.

As can best be seen from FIGS. 1 and 3, the roof paver elements 20 have bar-shaped raised portions 46 on their upper surfaces, so that when the roof paver elements 20 are in place on a roof, the raised portions 46 provide a tread for roof traffic, such as maintenance crews and repairmen, and also constitute vortex generators which break up the flow of air along the roof paver elements, which can cause uplift and displacement of the elements, by creating swirls of air which destroy the negative pressure causing the uplift.

Each paver element 20 terminates at its ends with structure defining one half of a dovetail groove 24. Specifically, each end of the paver element 20 includes a rib 32 spaced inward from the lateral edge of the planar portion 30 by a distance equal to one half the width of a dovetail groove 24 and a foot 34 or 36 having an outwardly directed toe 34*a* or 36*a*, so that when the end of the paver element 20 is laid in abutment with the end of the adjacent paver element, a composite dovetail groove 24 for receiving the connector members 26 is defined, as can be seen in FIG. 1. The connector members 26, which are received snugly between aligned dovetail grooves 24 in adjacent roof paver elements 20 further prevent the displacement of the elements. The dovetail grooves 24 which lie entirely within one roof paver element 20 also can receive the connector members 26, as shown in FIG. 1, so that a connector member can have one end inserted in a composite dovetail groove 24 and the other end inserted in a dovetail groove 24 lying entirely within one roof paver element 20. The connector members 26 can also connect two dovetail grooves 24 lying entirely within their respective roof paver elements 20 and, where the roof paver elements of adjacent courses are in alignment, the connector members 26 can connect two composite dovetail grooves 24.

Especially in cases where the connector members 26 are used in dovetail grooves 24 defined entirely by one roof paver element 20, stops, such as radial projections 37, for engaging the ends of the ribs 22 or feet 34 and 36 are contemplated to prevent the connector members 26 from being pushed too far into the dovetail grooves 24 in a roof paver element 20 in one course by the element in the next course as it is being moved into abutment with the element in the first course. Although connector members 26 are employed in only two of the dovetail grooves 24 in each roof paver element 20 illustrated in the embodiment of FIG. 1, any number of the remaining dovetail grooves 24 can be employed to receive additional connector members 26 if stronger integration of the roof paver elements 20 is desired.

Figure 6:
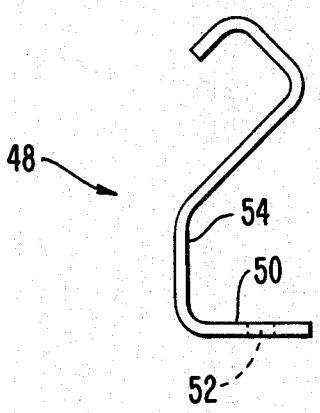
FIG. 6 is a side view of a perimeter clip according to the present invention.
Figure 7:
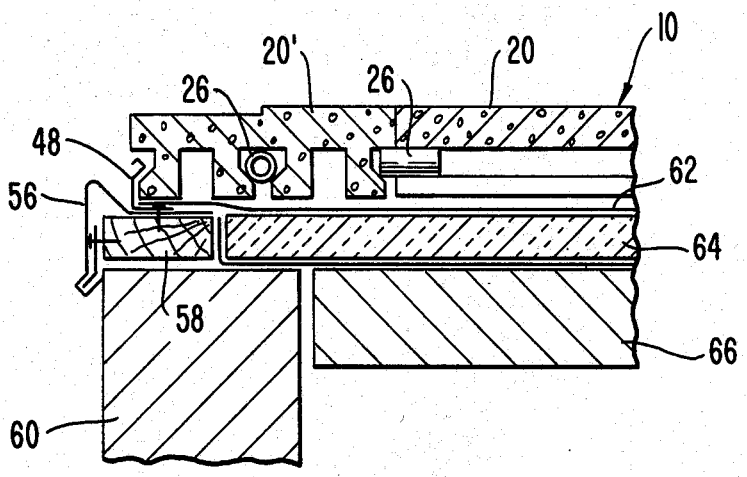
FIG. 7 is a schematic cross section of a roof paver system installation employing the perimeter clips of FIG. 6.
Figure 8:
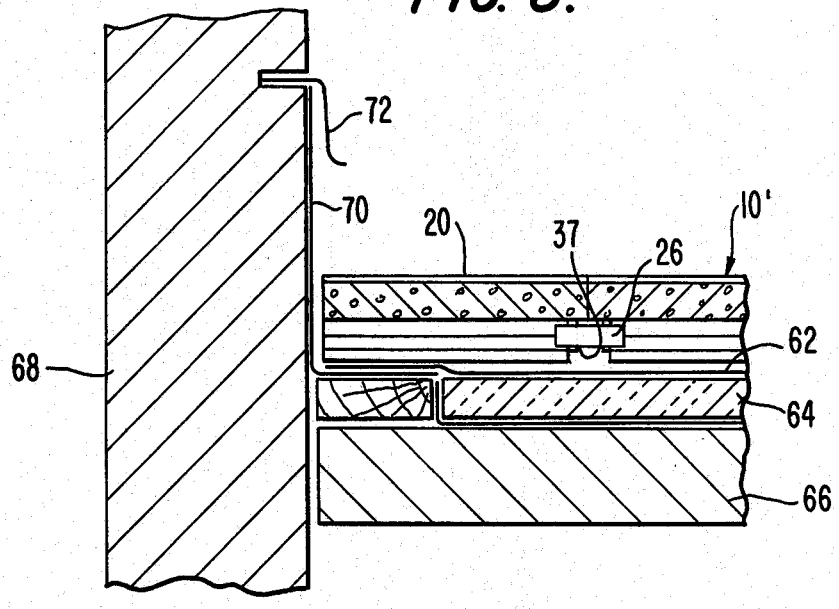
FIG. 8 is a schematic cross section of another roof paver system installation.
Figure 9:
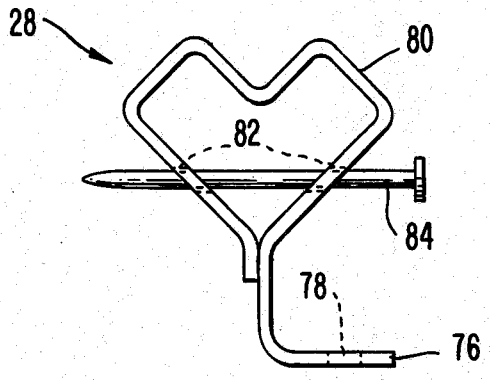
FIG. 9 is an end view of a batten according to the present invention.

In order to allow the alignment of the roof paver elements 20 at the perimeter of the roof paver system 10, and to anchor the elements in place, anchoring and alignment devices such as the clip 48 illustrated in FIG. 6 are provided. The clip 48, which can be made, for example, of metal or plastic, includes a base portion 50 having at least one aperture 52 for receiving nails or other fasteners, and an angular portion 54 shaped to mate with the outwardly directed toe 36*a* at the end of a roof paver element 20'. As can best be seen from FIG. 7, in which a portion of the roof paver system 10 is shown on a roof having a low gravel stop fascia 56, the clips 48 can be nailed to a nailer 58 at the top of a wall 60 to which the fascia 56 is also nailed. A membrane 62, which overlies insulation 64 on top of a roof deck 66, can also overlie the base portion 50 of the clips 48 which have been secured to the nailer 58. The clips 48 constrain the end of the perimeter course roof paver element 20', which in this case is one half of the element 20 shown in FIG. 2 and is laid perpendicular to the course of roof paver elements inside of the perimeter course. The dovetail grooves 24 of the roof paver elements 20' in the perimeter course can be secured to one another by the connector members 26, and the elements 20' of the perimeter course can be connected to the inner elements 20 by connector members extending from the dovetail grooves 24 of the inner members and received perpendicularly in the one half dovetail groove, between the toe 34*a* and the lower surface of the planar portion 30, defined at the inner end of the elements 20'. FIG. 8 shows another installation of a roof paver system 10' on a roof having a parapet 68, including flashing 70 and counterflashing 72, for which the perimeter clips 48 are not needed.

As is illustrated in FIG. 1, the roof paver system 10 can also include the elongate battens 28 for holding down the roof paver elements 20 and for preventing them from sliding, especially on roofs having a relatively high slope. The battens 28 can be made of metal or plastic, for example, like the clips 48 and include a base portion 76 including a plurality of spaced apertures 78 for receiving nails or other fasteners to secure the battens 28 to the roof. The dovetail shaped grooves 24 of the roof paver elements 20 are slidingly received on the battens 28, which have a complementary portion 80 dovetail shaped in cross section, by which the battens 28 hold the paver elements 20 down. The battens 28 include a plurality of spaced transverse openings 82 defined, for example, in the dovetail portion 80 and sized to receive a nail 84 or other thin element which engages the ends of the ribs 32 or feet 34 and 36, thereby preventing the paver elements from sliding along the battens 28.

Although the roof paver element is described herein as being made of concrete, other suitable materials may be employed, such as ceramics or plastics. Furthermore, the roof paver elements may be employed in structures other than as part of a roof paver system.

Thus, it will be appreciated that as a result of the invention, a highly effective roof paver element and system is provided for covering roofs, and that it will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

I claim:

1. A roof paver element for providing ballast for a roof comprising:

an elongate planar portion; and a plurality of drainage grooves defined by spaced, generally parallel ribs projecting from the planar portion and terminating in feet each having a bottom surface for contacting the roof, said bottom surface being greater in area than every cross section of the rib above the foot and parallel to said bottom surface, wherein each foot has a projecting toe portion, the toe portions on at least some of the feet face one another to define with their ribs drainage grooves shaped to retain a member for connecting the roof paver element to a similar roof paver element, and said drainage grooves defined by said feet are generally dovetail shaped.

2. The roof paver element according to claim 1 wherein the feet have a length shorter than the dimension of the planar portion parallel to the length of the feet, whereby the feet define with the planar portion a drainage passage transverse to said drainage grooves.

3. The roof paver element according to claim 1 wherein said planar portion has, on a surface opposite to said drainage grooves and said ribs, means for generating vortexes in air which passes across said surface.

4. The roof paver element according to claim 3 wherein said vortex generating means comprises at least one raised portion on said surface.

5. The roof paver element according to claim 4 wherein said at least one raised portion has the general shape of a bar.

6. The roof paver element according to claim 5 wherein said element is made of concrete.

7. A roof paver element for providing ballast for a roof comprising:

an elongate planar portion; and a plurality of drainage grooves defined by spaced, generally parallel ribs projecting from the planar portion and terminating in feet each having a bottom surface for contacting the roof, said bottom surface being greater in area than every cross section of the rib above the foot and parallel to said bottom surface, wherein said parallel ribs define the width of said drainage grooves, and the width of some of said drainage grooves is tapered along the length of the drainage grooves for breaking vacuum with a mold.

8. The roof paver element according to claim 1 wherein said planar portion includes a means for defining a tread, said tread defining means comprising at least one raised portion.

9. A roof paver system for providing ballast for a roof comprising:

a plurality of roof paver elements, each including a plurality of drainage grooves; and a plurality of connector members, each connector member positioned within the drainage grooves of adjacent roof paver elements, wherein at least some of said grooves are narrower adjacent the roof than remote from the roof, and the connector members have a hollow cross section.

10. The roof paver system of claim 9 wherein each connector member mates with said drainage grooves.

11. The roof paver system of claim 9 wherein said connector members are retained snugly in said drainage grooves.

12. The roof paver system of claim 9 wherein said roof paver elements are made of concrete.

13. The roof paver system of claim 9 wherein said connector members are made of plastic.

14. The roof paver system of claim 9, further comprising means for aligning said roof paver elements and securing said roof paver elements to said roof.

15. The roof paver element according to claim 9 wherein each connector member extends only partially into the drainage grooves of said roof paver elements.

16. A roof paver system for providing ballast for a roof comprising:

a plurality of roof paver elements, each including a plurality of drainage grooves; and a plurality of connector members, each connector member positioned within and mating with the drainage grooves of adjacent roof paver elements, wherein said drainage grooves in which said connector members are positioned are dovetail shaped and said connector members are circular in cross section.

17. The roof paver system of claim 16 wherein said connector members are retained snugly in said drainage grooves.

18. A roof paver system for providing ballast for a roof comprising:

a plurality of roof paver elements, each including a plurality of drainage grooves; and means for preventing said roof paver elements from moving in a direction parallel to said grooves, said movement preventing means including elongate members received in at least one of said grooves of at least some of said roof paver elements and having openings to receive an element generally transverse to said elongate members for engaging said roof paver elements.

19. A roof paver system according to claim 18 wherein said elongate members have apertures for receiving fasteners to fasten said elongate members to the roof.

20. A roof paver system according to claim 18 wherein at least some of said grooves are narrower adjacent the roof than remote from the roof, and the elongate members have a shape complementary to said grooves.

21. A roof paver system for providing ballast for a roof comprising:

roof paver elements positioned at the perimeter of the roof paver system, each said roof paver element including at least one outwardly projecting toe portion, and means for aligning and anchoring said roof paver elements, said aligning and anchoring means comprising a plurality of elements each having a base portion and an angular portion shaped to mate with said outwardly projecting toe portions of said roof paver elements.

22. The roof paver system according to claim 21 wherein said base portion defines at least one aperture for receiving a fastener.

23. The roof paver system according to claim 21 wherein said angular portion includes a first segment connected to said base portion and a second extending over said base portion at an angle from said first segment.

24. A roof paver system for providing ballast for a roof comprising:

a plurality of roof paver elements, each including a plurality of drainage grooves;

a plurality of connector members, each connector member positioned within the drainage grooves of adjacent roof paver elements; and means for aligning said roof paver elements and securing said roof paver elements to said roof, wherein each roof paver element has roof-engaging feet including outwardly projecting toe portions, and said aligning and securing means comprises elements mating with the outwardly projecting toe portions of at least some of said paver elements.

25. The roof paver system of claim 24 wherein said elements have apertures for receiving fasteners to fasten said elements to the roof.

* * * * *

UNITED STATES PATENT AND TRADEMARK OFFICE

CERTIFICATE OF CORRECTION

PATENT NO. : 4,655,018

DATED : April 7, 1987

INVENTOR(S) : Jorge Pardo

It is certified that error appears in the above-identified patent and that said Letters Patent is hereby corrected as shown below:

Claim 23, line 3, after "second", insert --segment--.

Signed and Sealed this

Twenty-fifth Day of August, 1987

*Attest:*

DONALD J. QUIGG

*Attesting Officer*

*Commissioner of Patents and Trademarks*